US006868650B2

(12) United States Patent
Sanchez

(10) Patent No.: US 6,868,650 B2
(45) Date of Patent: Mar. 22, 2005

(54) INSTALLATION FOR MANUFACTURING AND FILLING MULTIPLE-CAVITY BAGS MADE FROM A SHEET OF PLASTIC MATERIAL

(76) Inventor: Jesus Alfonso Sarria Sanchez, Apartado de Correos 107, Liria (ES), E-46160

( * ) Notice: Subject to any disclaimer, the term of this patent is extended or adjusted under 35 U.S.C. 154(b) by 0 days.

(21) Appl. No.: 10/653,774

(22) Filed: Sep. 3, 2003

(65) Prior Publication Data

US 2004/0040258 A1 Mar. 4, 2004

Related U.S. Application Data

(62) Division of application No. 09/869,636, filed on Jul. 2, 2001, now Pat. No. 6,622,459.

(51) Int. Cl.[7] ..... B65B 9/20
(52) U.S. Cl. ..... 53/202; 53/237; 53/551
(58) Field of Search ..... 53/450, 451, 474, 53/202, 237, 238, 239, 551, 552

(56) References Cited

U.S. PATENT DOCUMENTS

| | | | | | |
|---|---|---|---|---|---|
| 3,016,806 | A | * | 1/1962 | Schoen et al. | 493/202 |
| 3,469,364 | A | * | 9/1969 | Bischoff | 53/469 |
| 3,488,914 | A | * | 1/1970 | Csernak | 53/551 |
| 3,581,457 | A | * | 6/1971 | Gerlach et al. | 53/450 |
| 3,592,372 | A | * | 7/1971 | James et al. | 493/243 |
| 3,608,709 | A | | 9/1971 | Pike | |
| 3,795,081 | A | | 3/1974 | Brown, Jr. et al. | |
| 3,807,118 | A | | 4/1974 | Pike | |
| 3,918,235 | A | | 11/1975 | Brown, Jr. et al. | |
| 4,035,984 | A | * | 7/1977 | Gerlach et al. | 53/450 |
| 4,103,473 | A | | 8/1978 | Bast et al. | |
| 4,277,302 | A | | 7/1981 | Reid | |
| 4,706,439 | A | | 11/1987 | Barton | |
| 5,114,393 | A | | 5/1992 | Vettorato | |
| 5,174,096 | A | * | 12/1992 | Fukuda | 53/551 |
| 5,327,950 | A | | 7/1994 | Combrink | |
| 5,370,221 | A | | 12/1994 | Magnusson et al. | |
| 5,425,447 | A | | 6/1995 | Farina | |
| 5,505,040 | A | | 4/1996 | Janssen et al. | |
| 5,845,463 | A | | 12/1998 | Henaux | |
| 5,870,884 | A | | 2/1999 | Pike | |
| 6,006,501 | A | * | 12/1999 | Davis et al. | 53/451 |
| 6,085,491 | A | * | 7/2000 | Bois | 53/451 |
| 6,342,123 | B1 | * | 1/2002 | Rees et al. | 53/451 |

FOREIGN PATENT DOCUMENTS

| | | |
|---|---|---|
| EP | 0 768 245 | 6/1996 |
| ES | 554269 | 4/1986 |
| WO | WO 96/05050 | 2/1996 |

* cited by examiner

*Primary Examiner*—John Sipos
(74) *Attorney, Agent, or Firm*—Richard M. Goldberg

(57) ABSTRACT

An installation for manufacturing and filling multiple-cavity bags made from a sheet of plastic material, includes a forming column for forming a multiple-cavity bag, with the column being divided into three zones, a first zone forming a single tubular sleeve by a longitudinal seal of sheet edges thereof, a second zone for forming a bottom and cavities of the bag, and a third zone for filling and closing the bag and moving the closed bag away from the column, and a film feed mechanism for feeding plastic film to the forming column.

7 Claims, 2 Drawing Sheets

INSTALLATION FOR MANUFACTURING AND FILLING MULTIPLE-CAVITY BAGS MADE FROM A SHEET OF PLASTIC MATERIAL

This application is a division of Ser. No. 09/869,636, filed Jul. 2, 2001, now U.S. Pat. No. 6,622,459.

BACKGROUND OF THE INVENTION

The present invention relates to a process and equipment for manufacturing and filling bags with multiple cavities and a multiple-cavity bag obtained by said process.

This invention consists of a process and equipment for manufacturing and filling bags, for example the bags intended to contain building materials or other powdery, granular or pasty materials and in particular for containing materials which are meant to be mixed later on in specific proportions, as well as of a multiple-cavity bag obtained by said procedure, each one of said cavities being intended to contain a different type of material and generally intended to be mixed in a pre-determined proportion, said bag being made of a flexible laminar material such as a strip of plastic laminar material.

Until the present time, mortar, a mixture of sand and cement with water, has been made in the building industry on the site itself by means of arbitrarily mixing each of the components in a proportion that is not always right for the purpose which is being pursued.

When large quantities of material are involved, a particular quantity of bags of cement are used with a rough amount of weight in sand or a particular number of bags of sand. In the first of these cases it might occur that an improper proportion may lead to the unsatisfactory strength of the resulting construction and in the second bags of sand and bags of cement are used separately, which on a job site may lead to a disparity between the number of bags of both these products required, with an excessive surplus requiring transport for later use somewhere else, or location in different places of the two types of bag, which means that the operator has to carry out further conveyance.

To solve this problem a bag with multiple cavities has been developed, as well as a process and equipment for making and filling this.

State of the Art

Tubular columns with tubular filling around which a sheet of plastic material is wrapped so that this takes on a tubular shape are well-known. This type of columns prepares and fills a bag with a single cavity, without being able to do this with further cavities.

Patent EES-0554269 refers to a method for continuous preparation of a thermoplastic film bag. In accordance with this invention a tube of thermoplastic film is made and squashed whilst two parallel blades placed opposite each other are formed, then forming two pairs of closed diagonal seams, and finally removing the product obtained.

EP-0397 099 also refers to a method for making bags. This method is of particular use for making bags in a bellows and/or cushion shape, from polyethylene and/or thermosealable material, obtained from two sheets of material. This system is not useful either for producing and filling powdery, granular or pasty materials in bags with multiple cavities.

EP-0 593 861 A1 refers to a valve bagging machine. This has a double filling tube which allows sealed filling, preventing materials from escaping from the filling zone. The end pursued in this patent is not that of making and filling multiple cavity bags nor does it allow the problem mentioned to be solved either.

There are conventional bags with a single cavity which can separately contain each of the materials that have to be mixed. In this case the operator has to make the mixture with criteria that are often not very technical, apart from needing to go for two items and having to open each of these.

EP-596497 A1 refers to a bag for liquids intended to be mixed. It has a welding zone, that is relatively weak, so that by means of a slight pressure exerted on one of the two parts of the bag the liquid can be mixed inside this. Nevertheless, given the different nature of the products involved and the ends pursued, its characteristics are substantially different to those of the present invention.

It is well known that in buildings and other kinds of work a mixture of aggregate with cement as agglutinating agent has to be made to join the ceramic or ready-made items concrete for formwork, the last case being less frequent but similarly common due to the simplicity meant by purchasing this from companies supplying ready-mixed concrete.

Another possibility is pre-mixing in the same bag. There may be two different disadvantages, one of a technical nature and another of an economic kind. In the first case the mixing of a normally fairly damp aggregate with a cement would cause a setting or pre-setting which would remove some properties of the mix to be used, this being particularly serious in the event of buildings in which there are normally people present. As a solution to prevent setting there can be a drying process for the particular aggregate in order to remove the residual damp. This would mean an enormous rise in the costs of processing and packaging said products through the use of a power not today applied for said process, apart from needing a drying kiln, also unnecessary today.

One problem found with bags of cement nowadays is that the material of which these are made makes them prone to absorb humidity, which means they cannot be stored outdoors or in particularly damp environments.

SUMMARY OF THE INVENTION

According to the invention proposed, a bag can be obtained, for example for filling with aggregates and cements, in which a multiple cavity has been designed to contain the materials that have to be mixed, and in which the proportions in weight and/or volume of each of the materials are pre-determined.

To solve the bagging problem a process and corresponding installation has been designed to allow multiple-cavity bags to be made and filled, with each of these cavities being intended to contain powdery, granular or pasty products such as cements, aggregates and other building materials. A bag has thus been made of a plastic material which has at least two cavities, each of a suitable size in order to have a product in the right proportions to be mixed by an operator with no skill required at all, with the guarantee of the resulting product having all the characteristics attributed to said material in optimum conditions.

BRIEF DESCRIPTION OF THE DRAWINGS

In order to make the following explanation clearer two sheets of drawings will be enclosed with this descriptive report, representing the essence of this invention in five figures, and in which.

DETAILED DESCRIPTION

Figure 1:
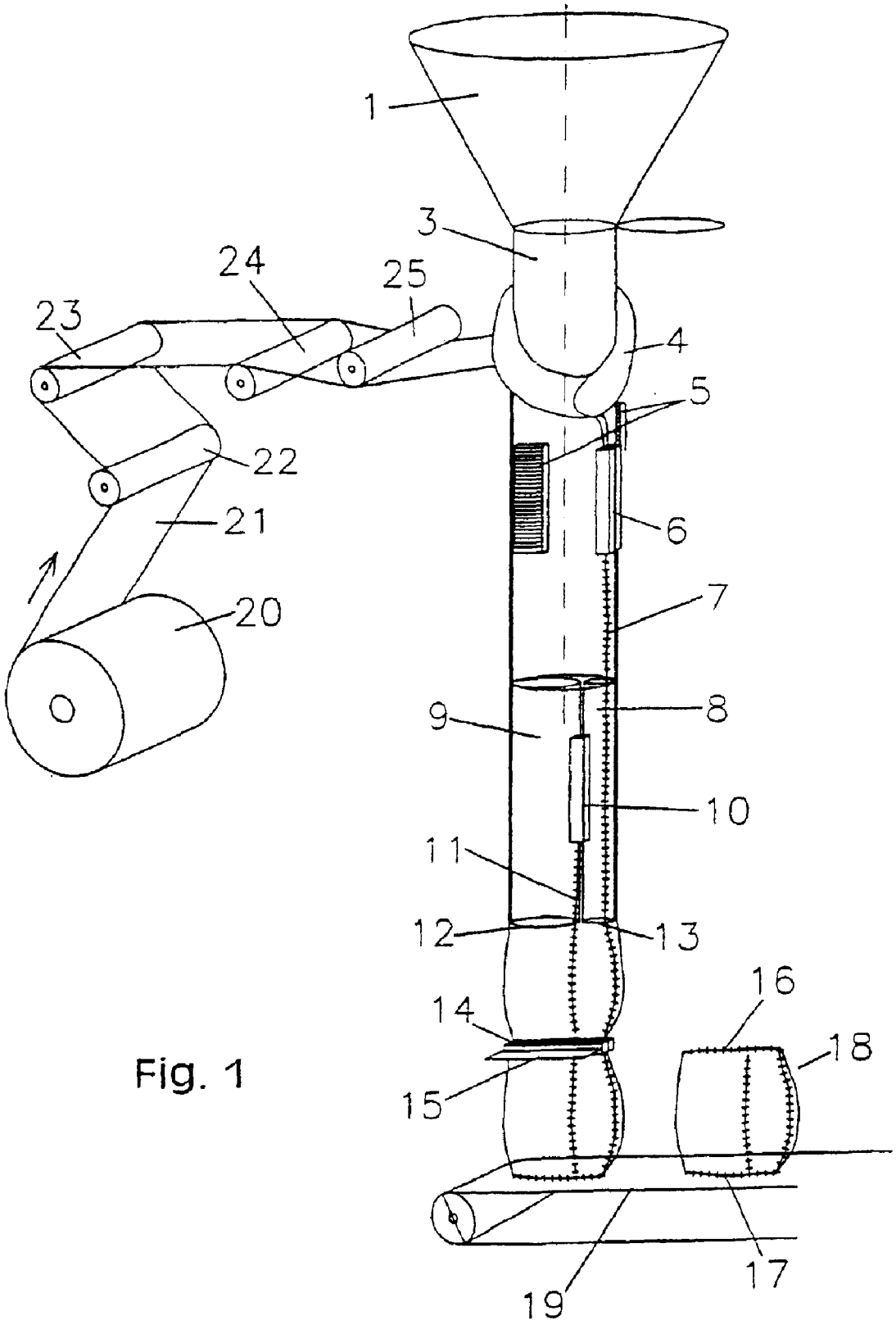
FIG. 1 represents an overall schematic view of the equipment for filling multiple cavity bags.
Figure 2:
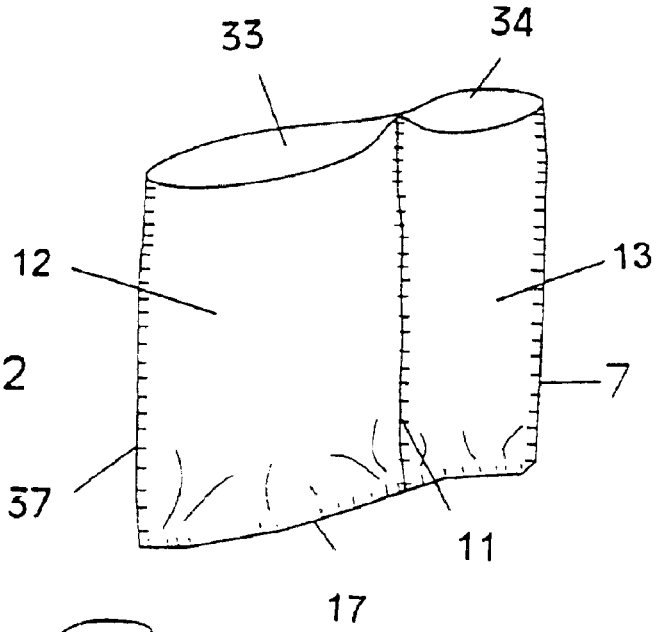
FIG. 2 represents a view of an unclosed bag according to this invention.

In said figures the numbers indicate the following items:

1 is a multiple filling hopper of at least two conduits, though there could be more of these if the bag has to have more than two cavities, which is fitted with means for weighing the materials to be bagged, thus enabling controlled measurement of the material to be bagged.

3 is a column for forming and filling,

4 is a securing collar

5 are traction devices

6 is a first sealing device

7 is an outer longitudinal seam or seal

8 is a first forming tube for a first cavity

9 is a second tube for forming a second cavity

10 is a second sealing device

11 is a second internal longitudinal seam or seal, between the cavities

12 is a first cavity

13 is a second cavity

14 is a sealing device for sealing the bottom of the bag,

15 is a means for cutting and separating the previous bag

16 is the upper weld of the bag

17 is the lower weld of the bag

18 is a double cavity bag already made and filled

19 is a conveyor belt for transporting the filled and formed bags

20 is a reel of laminar plastic material

21 is a strip or sheet of plastic material

22, 23, 24 and 25 are tensor rollers

33 is the opening or loading mouth of the first cavity

34 is the opening or loading mouth of the second cavity and

37 is a second lateral seam or weld.

The process includes the following stages:

forming from at least one laminar strip of plastic material of a wrapping in sleeve form, sealing or welding of said wrapping to form a sleeve, sealing or welding of the lower and central parts and cutting off from the previous bag, filling each of the cavities which form the bag, closing the filling mouths, cutting off from the next bag, and removal of the closed bag.

The bag can be made up from a sleeve or one or more sheets of plastic material, given the relevant inner and outer folds and welds, the cavities into which this is divided thus being defined. The central dividing weld(s) may lie in parallel or perpendicular to the folding line, if the bag has been made in a single folded sheet.

FIG. 1 illustrates the three zones of sleeve formation, cavity formation and filling and closing of the bag of which the installations consists. In this 20 is a reel of a suitable plastic material which is to constitute the bag wrapping. 21 is the plastic sheet or film, which, through a number of tensor rollers 22,23,24 and 25, goes in behind a securing collar to the forming column.

The sideways-slipping tendency of laminar materials driven by rollers is well-known, meaning that these do not fulfil the required function through moving and creasing up and thus form a faulty bag. Apart from the economic losses through faulty manufacture, the sheet can also move over to one of the shafts, even blocking this up and preventing this from working until assistance is given by the maintenance service.

To solve this problem it has been envisaged that one of the rollers 25 should have a position detector for the edge of the sheet on both sides, so that in view of its position, when there is a sideways movement this forces this or another roller 24 to tilt to a greater or lesser extent depending on said position.

After being centred in position, the sheet goes between the upper part of a column 3 and a securing "collar" 4, guided by pulling devices 5. After reaching a first position a first sealing device 6 is activated, which gives on to the tubular sheet structure, around the column, sealing the bag in its longitudinal seam 7.

After making the first seal, the plastic tube is fed along in order to reach a second position. In this position there are at least two tubes 8 and 9, of suitable sizes depending on the need for proportion between the sizes of the bags to be made. In this second position a second longitudinal seal 11 is made by means of a sealing device 10, dividing the bag into at least two tubular zones 12 and 13. In this position the bag is sealed at the bottom 17 by means of a sealing device 14, which has in turn means 15 for cutting and separating this from the preceding bag.

In the third zone of the column, the already formed bag is supported, prior to being cut off from the following on a conveyor belt with rollers or similar 19, ready for filling each of the cavities by means of tubes located inside each of the cylinders 8 and 9. Said tubes come from the corresponding cavities fitted in turn in hopper 1. As soon as both cavities have been filled, the equipment proceeds to seal and cut the bag off from the following one.

The sealing and separation from the last of the bags in respect of the penultimate one is performed in a single action, so that a welding strip of a certain width is made with a cut in the centre.

The conveyor belt 19 has the function of removing the already cut bag in order to allow the next one to be positioned.

In order to prevent the bag from bursting open when possibly piled, a slight perforation has been designed in the thickest part in order to allow the air inside to get out when said bag is compressed, for example when being piled up.

In FIGS. 2, 3, 4 and 5 the number 12 indicates a greater cavity of the bag. This cavity, in the event of building materials, is designed to contain the aggregate, since this is the product needed in greatest amount. In said FIG. 13 shows the smaller cavity of the bag which is the subject of this invention designed to house, for example, a cement. 33 and 34 show the openings of both cavities before being closed or after being opened. Since this is a bag made from a sheet of plastic material, sealing zones are designed, some at the sides 7 and 37 one in the centre 11, and the upper and lower ones 17 and 16.

Figure 3:
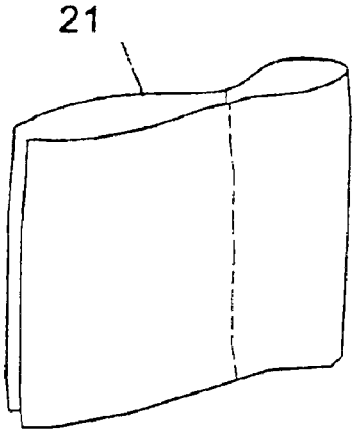
FIG. 3 shows one form of embodiment of said bag by folding a sheet of plastic material across one of its sides.

In the embodiment shown in FIG. 3 the number 21 shows the strip or sheet of plastic material of which the bag is made, in which the central welding zone has been marked. In this case, apart from said central zone, the lower and side zones must also be sealed prior to filling.

Figure 4:
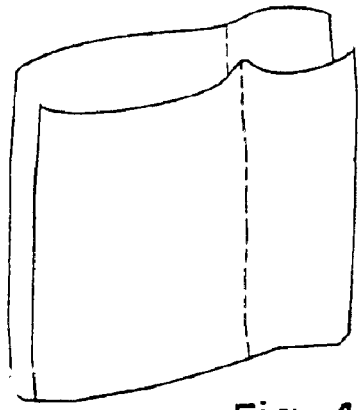
FIG. 4 shows one form of embodiment of said bag by folding a sheet of plastic material along its base.
Figure 5:
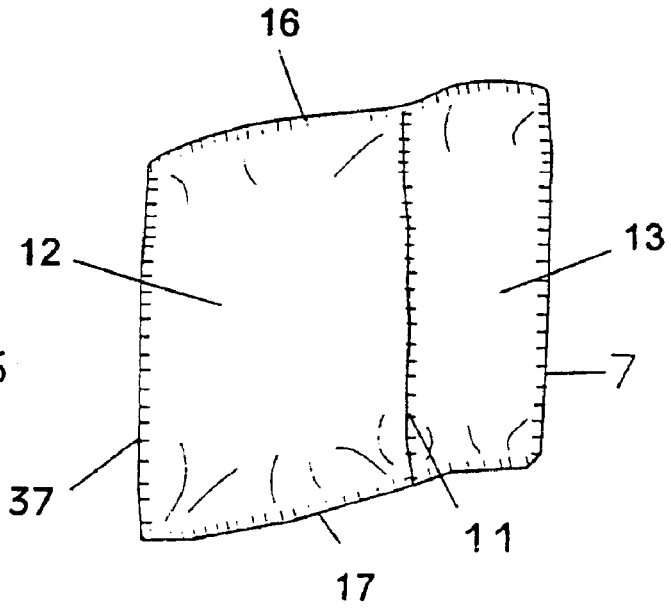
FIG. 5 shows a general view of the closed bag.

In the embodiment shown in FIG. 4 number 21 shows the sheet of plastic material of which the bag is made, also showing the central welding zone. In this case apart from said central zone the sides have to be sealed before filling.

As regards the process of making said bag, two main solutions have been designed, essentially shown in said FIGS. 3 and 4.

In either of the two cases the bag is made from a single sheet of plastic material, which is folded in the first case along one of the sides, whilst in the other this is folded at the bottom, with the sealing welds being made in each of the previously described zones.

One possible alternative to said solutions could be making the bag from two different sheets of plastic material, though this has not been shown, but this would not be advisable due to requiring a dual supply of plastic sheets, with the added disadvantages in production that might be meant by the reels not finishing at the same time, amongst others.

Also included within the sphere of this invention is the manufacture of a bag with more than two cavities for products intended to be mixed, such as an aggregate and two kinds of cement, or vice-versa, in which case the installation would consist of more than two tubes for forming and filling each of the cavities of the bag, even when the explanation has been specifically given for two.

For application in the production and filling of bags with powdery, granular or pasty materials.

What is claimed is:

1. Installation for manufacturing and filling multiple-cavity bags made from a sheet of plastic material, comprising:

a forming column for forming a multiple-cavity bag, with said column being divided into three zones, including:

a first zone forming a single tubular sleeve by means of a longitudinal seal of sheet edges thereof comprising of a single tube, a second zone for forming a bottom and cavities of the bag, the second zone being formed of at least two non concentrics cores separate from each other and arranged internally of said tubular sleeve for defining two side-by-side cavities, and a longitudinal sealing mechanism between said cores, and wherein the bag is filled and closed downstream of the second zone and the closed bag is moved away from the column, and a film feed mechanism for feeding plastic film to the forming column.

2. Installation according to claim 1, wherein the film feed mechanism includes a devise for detecting lateral movement of the plastic film, as well as a device for correcting said movement adjacent one of tensor and traction rollers for the plastic film.

3. Installation according to claim 2, wherein the device for correcting the lateral movement of the plastic film includes a device for inclining said one of said tensor and traction rollers.

4. Installation according to claim 1, wherein at a top of the first zone into which the installation is divided, the column has a collar surrounding the column which allows the plastic film to pass between the collar and said column.

5. Installation according to claim 1, further including a traction mechanism and a longitudinal sealing zone to seal the sheet edges of the plastic film, in the first zone.

6. Installation according to claim 1, wherein the second zone includes a zone for sealing and cutting a lower part of the bag off from a previous bag.

7. Installation according to claim 1, wherein the third zone includes;

a support base formed by a conveyor device on which the bag rests while being filled, tubes coming from each of divisions in which a hopper is divided, which go inside the cores for filling each of the cavities in the bag, and an upper bag closing zone, coinciding with the former of the base of the following bag.

* * * * *